US006565274B1

(12) United States Patent
Lyons

(10) Patent No.: US 6,565,274 B1
(45) Date of Patent: May 20, 2003

(54) SHEET PRINTING AND DISCHARGING APPARATUS

(75) Inventor: Dale R. Lyons, Suwanee, GA (US)

(73) Assignee: NCR Corporation, Dayton, OH (US)

( * ) Notice: Subject to any disclaimer, the term of this patent is extended or adjusted under 35 U.S.C. 154(b) by 12 days.

(21) Appl. No.: 10/037,047

(22) Filed: Dec. 31, 2001

(51) Int. Cl.[7] ..... B65H 29/58

(52) U.S. Cl. ..... 400/619; 400/611; 101/66; 271/303

(58) Field of Search ..... 271/303; 400/619, 400/617, 621, 611; 101/66

(56) References Cited

U.S. PATENT DOCUMENTS 4,381,705 A * 5/1983 Roes et al. ..... 101/69
4,535,892 A * 8/1985 Roes et al. ..... 209/3.3
4,732,377 A * 3/1988 Fenske et al. ..... 271/303
5,649,776 A * 7/1997 Sugimoto et al. ..... 400/617
5,879,090 A 3/1999 Hoyt et al.
5,951,004 A * 9/1999 Hadfy-Kovacs et al. .... 271/184
6,059,160 A 5/2000 Longrod
6,186,496 B1 * 2/2001 Marasco et al. ..... 271/186
6,276,602 B1 8/2001 Henderson et al.
6,293,542 B1 9/2001 Bokelman
6,398,212 B1 * 6/2002 Miyake ..... 271/186
6,478,490 B2 * 11/2002 Kelley et al. ..... 400/624

* cited by examiner

*Primary Examiner*—Ren Yan
*Assistant Examiner*—Dave A. Ghatt
(74) *Attorney, Agent, or Firm*—Maginot, Moore & Bowman LLP

(57) ABSTRACT

A diverter is integrated into a printer apparatus having a feed mechanism for feeding the sheet from a supply location through a printer mechanism to a collection location, and a presenter mechanism for drawing the sheet from the collection location to a discharge location. The diverter is pivotably mounted between the printer mechanism and the collection location so that the diverter is movable by contact of the sheet with a first surface of the diverter. The diverter is gravity-biased to a neutral position in which a second surface is aligned to receive the sheet from the collection location and direct the sheet to the presenter mechanism. In a preferred embodiment, the diverter includes a generally triangular-shaped body, with a pivot axis and a center of gravity offset from the pivot axis.

20 Claims, 2 Drawing Sheets

SHEET PRINTING AND DISCHARGING APPARATUS

BACKGROUND OF THE INVENTION

The present invention relates to systems and devices for printing and handling sheets. In particular, the invention can be used with a receipt printing, storage and presenting apparatus, in which a plurality of transactions are printed on a continuous sheet or web.

With increasing frequency, businesses are turning to self-service terminals for conducting a variety of transactions. For instance, automated teller machines (ATMs) are omni-present. In addition, many retail stores are turning to self-checkout facilities in which the shopper rings up and pays for his/her purchases without the need of a cashier.

In each of these types of systems, a paper printing and presentation apparatus is utilized for providing a printed receipt, transaction summary or the like. Naturally, the length of the receipt or printed document depends upon the nature, length and extent of the transaction. For instance, in a grocery store setting, an automated check out may involve the purchase of dozens of items, which can lead to a fairly lengthy receipt. In other instances, the transaction is fairly short, such as a grocery purchase of only a few items, or a brief ATM transaction.

In order to address this high degree of variability, most self-service terminals rely upon a continuous supply of paper, such as a receipt roll. The paper is fed through a printing mechanism and the printed material is directed to a collection or storage bin until the printing is complete. At that point, the continuous sheet or web of paper is cut to form an individual receipt. The printed receipt is then pulled from the collection location and conveyed to a discharge opening or presentation mechanism to be retrieved by the customer.

In earlier receipt printing systems, the receipt was continuously discharged as it was printing. This approach presented problems, particularly in self-service installations, and most particularly where a lengthy receipt was being printed. Thus, the typical self-service terminal now relies on the approach mentioned above in which the printed receipt is temporarily stored within the printer itself for subsequent discharge.

In most self-service terminals of the types described above, it has been desirable to keep the terminal as small as possible while still performing its appointed printing function. The approach of temporarily storing the printed sheet of material for subsequent presentation or discharge has help to reduce the size of the self-service terminal. Another feature that has led to a reduction in size of the terminals is the ability to reverse the direction of travel of the printed sheet within the machine. For instance, in a typical installation, the continuous roll of paper is withdrawn from a supply location and conveyed in a first direction of travel or path through a printing mechanism. The sheet continues in this direction of travel to a collection or storage location. Once the printing operation is complete, the now printed sheet is conveyed in a second direction of travel or path toward a presenter mechanism that presents the printed sheet or receipt for removal by the user. Frequently, reversible pinch rollers will be used to convey the sheet in both directions.

One problem encountered in terminals of this type (i.e., terminals in which the direction of travel of the sheet or receipt is reversed) is providing a mechanism for alternately directing the sheet to a storage location and then later to a discharge or presenting location. In most current systems, the direction of travel of the sheet or receipt is governed by a mechanical or electrical actuator. In one type of installation, a guide plate is moved by way of a solenoid to direct the sheet of material first to the storage location, and then subsequently to a presenter unit.

Other solutions to the problem of reversing the direction of the paper travel can be found in U.S. Pat. Nos. 5,879,090 and 6,293,542. In the device shown in the '090 patent, the orientation of pinch rollers used to convey the printed sheet is changed to direct the sheet to an overflow bucket and then to remove the sheet from the bucket for presentation. The system in the '542 patent includes a guide channel mounted on a cam plate that is mechanically rotated between storage and discharge orientations.

While many similar devices for rerouting the direction of travel of a sheet within a terminal are also known, all of these approaches require some form of mechanical or electrical drive system to accomplish this function. Of course, such mechanical or electrical drive systems are susceptible to disruption or failure. Consequently, there is a need for a device for rerouting the direction of travel of a sheet within a printing apparatus that does not rely on such mechanical or electrical control.

SUMMARY OF THE INVENTION

In order to address this un-met need, the present invention contemplates a printer apparatus comprising a printer mechanism for printing on a sheet, a feed mechanism for feeding the sheet from a supply location through the printer mechanism to a collection location and a discharge mechanism for discharging the sheet from the collection location to a discharge location. In accordance with the invention, a diverter is disposed between the printer mechanism and the collection location. The diverter defines a first surface configured to direct the sheet to the collection location and a second surface configured to direct the sheet to the discharge location. In one aspect of certain embodiments, the diverter is movable by contact of the sheet with the first surface from a neutral position in which the second surface is aligned to receive the sheet from the discharge mechanism and a displaced position relative to the neutral position.

Most preferably, the diverter is pivotably mounted within the printer apparatus. In certain embodiments, the diverter includes a generally triangular-shaped body, in which the first and second surfaces extend from a common edge, and a base portion is defined between the surfaces opposite the common edge. One feature of the invention contemplates; a pivot axis adjacent the base for pivotably mounting the diverter. In a further feature, the center of gravity of the diverter is offset from the pivot axis toward the common edge. With this feature, the diverter is biased to a particular position by the action of gravity along the center of gravity.

In accordance with the present invention, the diverter is mounted above the feed mechanism so that the diverter is movable against the force of gravity by contact of the sheet with the first surface. In other words, as the sheet is conveyed by the feed mechanism, it contacts the feed surface of the diverter, which causes the diverter to pivot about its axis to a position in which the diverter directs the sheet toward the storage location.

In one embodiment, the diverter is a generally one-piece elongated body. In another embodiment, the diverter includes a plurality of ribs supported on an axle pivotably mounted within the apparatus. In either case, the body or the ribs can be formed as described above.

It is one object of the present invention to provide a mechanism for changing the direction of travel or path of a sheet within a printing apparatus. A further object is to eliminate the need for an electrically or mechanically operated mechanism for re-directing the path of a sheet or receipt in a printer apparatus.

These and other objects and benefits of the invention can be appreciated upon consideration of the following written description and accompanying figures.

DESCRIPTION OF THE PREFERRED EMBODIMENTS

Figure 1:
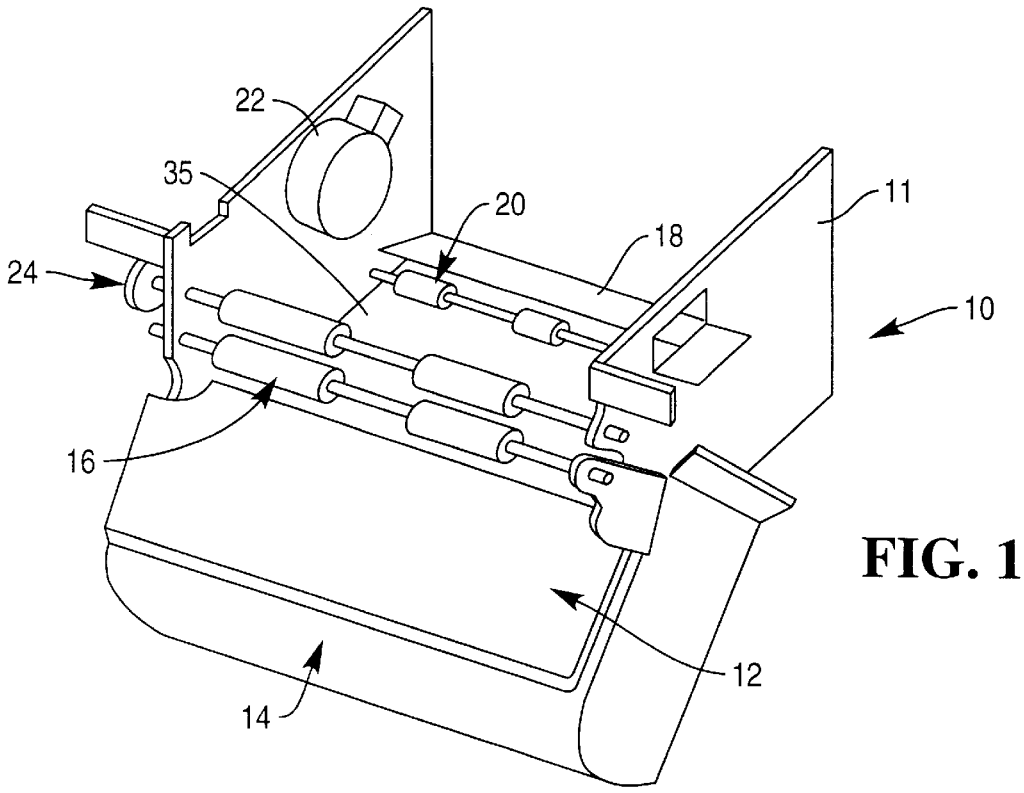
FIG. 1 is a top perspective view of a printing mechanism for use with the present invention.

For the purposes of promoting an understanding of the principles of the invention, reference will be made to the embodiments illustrated in the drawings and specific language will be used to describe the same. It should be understood that no limitation to the scope of the invention is hereby intended by the description of these preferred embodiments. It should further be understood that such alterations and modifications to the illustrated embodiments, or such further applications of the principles of the invention are contemplated as may normally occur to a person of ordinary skill in the art to which the invention relates.

The present invention relates to a diverter mechanism for use within a paper or receipt printing apparatus. In particular, the diverter mechanism is mounted within the printer apparatus to permit unconstrained movement of the diverter mechanism between a first position, in which the diverter mechanism directs the sheet to a collection location, and a second position, in which the diverter directs the sheet to a presentation or discharge location.

In one aspect of the invention, the diverter is pivotably mounted within the printing apparatus and is configured to be gravity-biased to one of the two positions. Most preferably, the diverter mechanism is gravity-biased to the second position. In a further aspect of the invention, the diverter mechanism is mounted within the printer apparatus so that the diverter can be moved to the first position by passage of the sheet of paper through the diverter mechanism.

Referring now to FIG. 1, details of the present invention can be understood in the context of a description of a typical printer apparatus. In particular, a printer apparatus 10 includes a frame assembly 11 that supports the various electrical and mechanical components. The frame assembly 11 is typically configured for mounting within a terminal of the type described above. The apparatus 10 includes a print head 12 that is configured to print on a sheet passing therethrough. The apparatus can include a paper feed mechanism 14 that draws the sheet from a supply location and directs the sheet through the print head 12 and through the in remainder of the printer apparatus 10.

Figure 2:
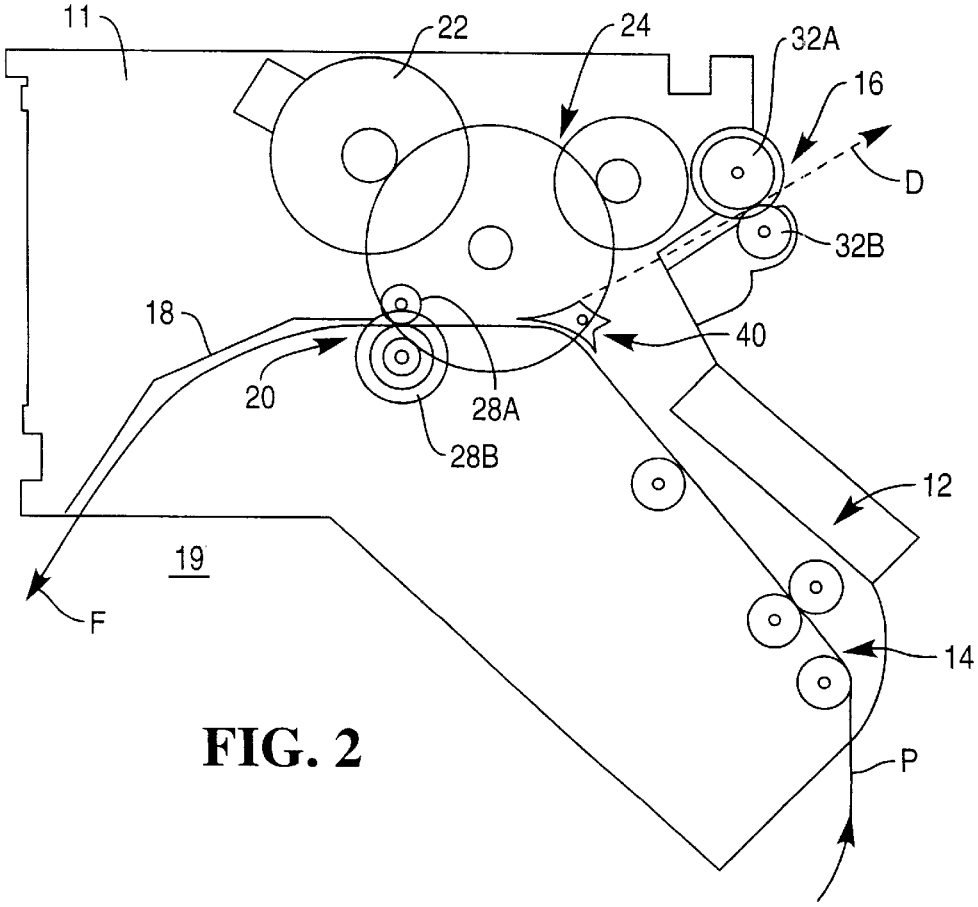
FIG. 2 is a side view of the printing mechanism as shown in FIG. 1, illustrating the travel path of a sheet passing through the printing mechanism, as shown with one embodiment of a diverter mechanism according to the present invention mounted therein.

The printer apparatus 10 also includes a collection deflector 18 that deflects the printed sheet to a collection location 19 (see FIG. 2). A drive mechanism 20 is provided that helps convey the sheet from the printed 12 to the collection location 19. Most preferably, the drive mechanism 20 can be reversed to direct the printed sheet to a presenter mechanism 16 at a discharge location of the printer apparatus 10.

In a typical printer apparatus, a drive motor 22 is provided that drives, or rotates, the various functional components through a transmission gearing arrangement 24. Preferably, the drive motor 22 is a reversible motor or stepper motor. The drive motor 22 can be arranged to control the paper feed mechanism 14, as well as the presenter mechanism 16 and drive mechanism 20. Alternatively, a separate drive motor can be provided for the paper feed mechanism 14, since that mechanism need not provide reversible directions of travel for the sheet or the roll of paper.

The relevant components of the printer apparatus 10 are best seen in the side representation of FIG. 2. In particular, a continuous sheet of paper P is fed from a supply location through the paper feed mechanism 14 and past or through the print head 12. The paper feed mechanism 14 can include a series of rollers and pinch rollers that maintain sufficient tension in the sheet of paper P while propelling the sheet through the printer apparatus 10.

The apparatus 10 can also include a pair of drive rollers 28A and 28B that form part of the drive mechanism 20. These drive rollers 28A, 28B help convey the continuous sheet of paper P to the collection location 19. Preferably, the printer apparatus 10 includes a deflector 18 that helps direct the now printed sheet of paper P in an orderly manner to the collection location. In this mode of operation, the sheet of paper P travels in a first path or feed direction F.

As explained above, the printer apparatus 10 includes a presenter mechanism 16 that presents the printed sheet or receipt for removal by the operator or customer. The presenter mechanism 16 can include a pair of discharge rollers 32A and 32B that help direct the sheet of paper along a discharge path D. Not shown in FIGS. 1 or 2 is a cutting mechanism that severs the final receipt from the continuous roll of paper downstream of the supply location. The cutter mechanism can be situated in a number of positions along the feed direction F, but is most preferably disposed immediately adjacent the print head 12.

In the illustrated printer apparatus 10, the drive motor 22 simultaneously drives the driver rollers 28A, B and the discharge roller 32A, B. Of course, when the sheet of paper P is being printed, no sheet is situated between the discharge rollers 32A and 32B. Once the direction of operation of the drive motor 22 has been reversed, the newly printed discrete sheet is then conveyed by the drive rollers 28A, B to the discharge roller at the presenter mechanism 16. It is of course understood that in lieu of a reversible drive motor 22, the transmission gearing 24 can be modified to change the direction of rotation of the sets of rollers, and thereby change the direction of travel of the sheet of paper P from the feed direction F to the discharge direction D.

It should also be understood that some type of sensing mechanism can be provided within the printer apparatus 10 to control the timing of operation of various components. For instance, a sensing mechanism could determine when the printing operation has been completed to thereby activate the cutting mechanism (not shown). The sensor, or a separate sensor, can determine the position of the discrete printed sheet relative to the drive rollers 28A, B to determine when it is time to reverse the direction of travel of the sheet.

As thus far described, the printer apparatus 10 can be of well-known construction. For instance the apparatus 10 can be an NCR 7401-K590 self-service printer, sold by the assignee of the present invention. Other similar printing apparatus are contemplated, provided they utilize a different feed and discharge path for the sheet being printed.

In accordance with a preferred embodiment of the present invention, a diverter mechanism 40 is integrated into the printer apparatus 10. In particular, the diverter mechanism 40 is situated between the print head 12 and the collection location 19, and most preferably in a diverter region 35, as illustrated in FIG. 1. As shown in the side view of FIG. 2, the diverter mechanism 40 can be mounted between the print head 12 and the discharge rollers 32A, B. As shown in FIG. 2, the diverter mechanism 40 allows the sheet of paper P to follow its feed direction F to the collection location 19. Alternatively, the diverter mechanism 40 can be moved to a position in which the discrete printed sheet or receipt can pass in the discharge direction D to the discharge rollers 32A, B.

Figure 3C:
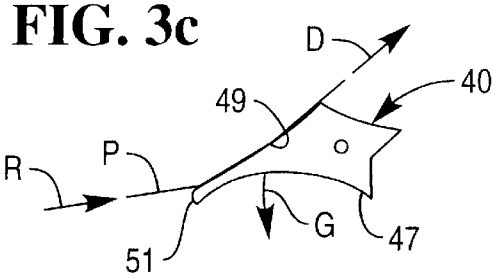
FIGS. 3*a*–3*c* are enlarged side views of the diverter mechanism depicted in FIG. 2, shown with the mechanism in different operational orientations.
Figure 3B:
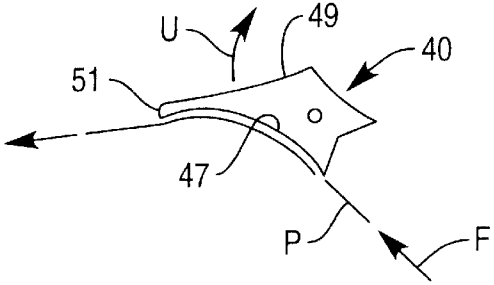
Figure 3A:
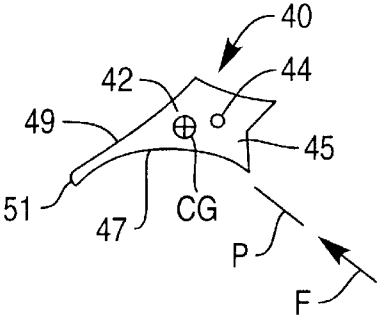

Details of the diverter mechanism 40 and its operation can be discerned with reference to FIGS. 3*a*–3*c*. In one embodiment of the invention, the diverter mechanism 40 includes a diverter body 42. The body 42 can constitute an elongated bar sized to span the diverter region 35 (FIG. 1) between portions of the frame assembly 11. The diverter body 42 includes a pivot axis 44. The axis 44 can include or be defined by an axle (not shown) that is supported in appropriate openings in the frame assembly 11.

The illustrations in FIGS. 3*a*–3*c* show one configuration for the diverter body 42. In particular, the body exhibits a generally triangular shape, with one leg of the triangle being defined by a feed surface 47 and another leg being defined by a presenter surface 49. The two surfaces meet at an edge 51 and are separated at their opposite ends by a base portion 45. In one aspect of this embodiment, the pivot axis 44 of the diverter body 42 is disposed within or adjacent to the base portion 45. More specifically, the pivot axis 44 is situated within the diverter mechanism 40 so that it is offset form the center of gravity CG of the body 42. As shown in FIG. 3*a*, the center of gravity CG is preferably situated between the pivot axis 44 and the edge 51 where the two surfaces 47 and 49 unite.

As can be appreciated from FIG. 3*a*, the feed surface 47 is arranged to face the sheet of paper P as it passes from the feed mechanism 14 along its feed direction F. This feed surface 47 redirects the path of the paper toward the drive rollers 28A, B as depicted in FIG. 2.

As shown in FIG. 3*c*, when the discrete printed sheet is to be with drawn from collection location 19, the sheet follows a reversing path R toward the diverter mechanism 40 so that the sheet of paper P contacts and is guided by the presenter surface 49. The presenter surface 49 thus redirects the path of the paper to the discharge direction D.

When viewed collectively, FIGS. 3*a*–3*c* illustrate the significance of the offset of the center of gravity CG relative to the pivot axis 44. Most preferably, the diverter body 42 is supported for rotation or pivoting around the axis 44 in as friction-free manner as possible. Thus, the diverter body 42 can be pivotably mounted on an axle extending through the body, or the axle can be affixed to the body and pivotably mounted to the fame assembly 11 by an appropriate bearing or bushing.

At any rate, in an important aspect of this embodiment of the invention, the diverter body 42 can exhibit substantially unconstrained movement or pivoting about the axis 44. In the context of the present invention, unconstrained movement means that the body 42 is free to move on its own accord, without being assisted or driven by a separate mechanical or electrical component. More pertinently, the diverter body is capable of substantially unconstrained movement between multiple operative positions to direct the sheet of paper in multiple directions. The diverter body 42 is preferably mounted within the printer apparatus 10 to assume a neutral position maintained substantially exclusively by the force of gravity acting on the offset center of gravity CG of the body.

As shown in FIG. 2 and FIG. 3*a*, the sheet of paper P approaches the diverter mechanism 40 while traveling along its feed direction F. When the paper contacts the feed surface 47 of the diverter body 42, the action of the sheet of paper P against the body causes it to pivot upward, in the direction of the arrow U, about the pivot axis 44. As the body pivots upwards, the edge 51 becomes generally aligned with the two drive rollers 28A, B so that continued movement of the paper P causes it to be directly engaged by the drive rollers. At this point, the rollers operate as described above to pull the sheet into the collection location 19. It is understood that other rollers or paper supports may be interposed in the space between the diverter 40 and the drive rollers 28A, B.

As shown in FIG. 3*c*, once the sheet of paper has been cut and travels past or beyond the diverter mechanism 40, the force of gravity causes the diverter body 42 to pivot downward in the direction of the arrow G. At this point, the edge 51 is essentially below the drive roller 28A, B so that the presenter surface 49 is essentially facing the rollers. In this position, when the paper P reverses its direction, as represented by the arrow R, the sheet contacts the presenter surface 49, which then operates to direct the sheet of paper to its discharge direction D.

In the illustrated embodiment, the diverter body 42 is normally positioned as shown in FIGS. 3*a*–3*c*, in the absence of a sheet of paper passing across the diverter body. In certain arrangements, the normal or neutral position of the diverter body would be with the edge 51 pointed vertically downward instead of the generally side-to-side orientation of the body shown in FIGS. 3*a*, 3*c*. However, it may be preferable to maintain a generally horizontal orientation to the diverter body 42, such as by addition of a stop or other feature, to limit the amount of downward rotation in the direction G of the diverter body 42. The stop can be formed as part of the axle extending along the pivot axis 44, or it can be integrated into the frame assembly 11.

Figure 4:
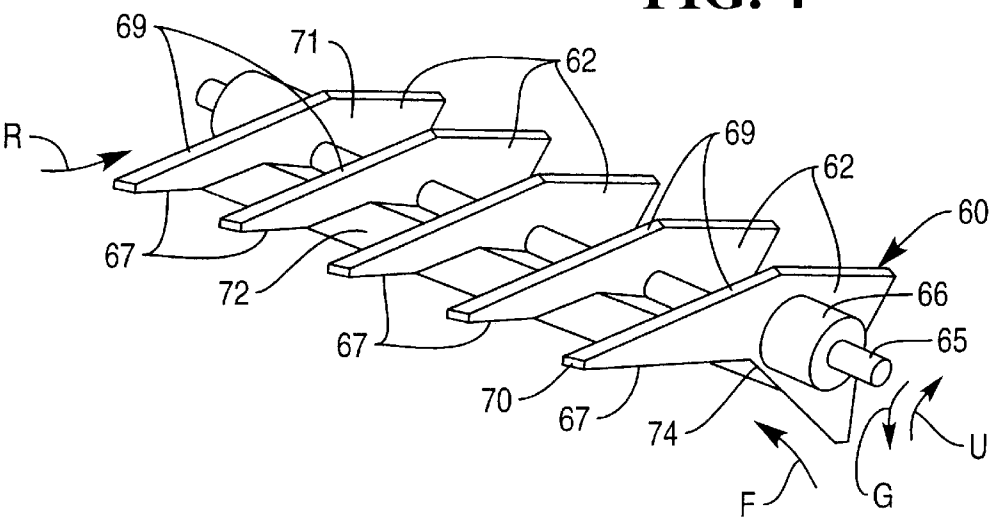
FIG. 4 is a side perspective view of a diverter mechanism according to an additional embodiment of the present invention.

Referring now to FIG. 4, a further embodiment of the diverter mechanism according to the present invention in depicted. In particular, a diverter mechanism 60 is formed by a plurality of individual diverter ribs 62. The ribs are attached or mounted to an axle 65. Preferably, the axle is sized to span across the diverter region 35 (FIG. 1) between portions of the frame assembly 11. The axle 65 can be provided with an enlarged hub 66 to maintain the diverter mechanism 60 centered within the diverter region 35. The hub 66 can also act as a bearing surface for generally friction-free pivoting of the axle and diverter mechanism 60.

As with the diverter mechanism 40, the mechanism 60, and more particularly each of the diverter ribs 62, can have a generally triangular shape. Thus, each rib 62 includes a feed surface or edge 67, a presenter surface or edge 69, and an edge 70 at the junction between the two surfaces. Likewise, the ribs 62 include a base portion 71 between the feed and presenter surfaces 67 and 69. The axle 65 is arranged within the base portion 71 so that the center of gravity of each rib 62 is offset toward the edge 70.

To add strength or rigidity to the diverter mechanism 60, an upper plate 72 can span substantially along the entire length of the mechanism 60 and provide a method for supporting each of the diverter ribs 62. In addition, a lower plate 74 can also be provided to support each of the ribs 62. The plates 72 and 74 may also help prevent a sheet of paper lodging or jamming between adjacent diverter ribs 62.

In the embodiment illustrated in FIG. 4, the feed surface 67 and the presenter surface 69 are each formed generally from straight lined segments, instead of the generally curved surfaces of the diverter mechanism 40. The surfaces 67 and 69 can be curved similar to that of the embodiment of FIG. 3*a*; however, such a configuration is not essential so long as the feed surface 67 facilitates smooth movement of the paper P across the surface. It is understood that the diverter mechanism 60 can be mounted within the printing apparatus 10 and can assume the same operational positions as the diverter mechanism 40 depicted in FIGS. 3*a*–3*c*.

With the embodiment shown in FIG. 4, the diverter mechanism can be formed as a single piece or a combination of components. For example, the diverter mechanism 60 can be molded from a high temperature plastic material. On the other hand, the mechanism 60 can be formed of metal with each of the ribs 62 and the upper and lower plates 72, 74 being formed from metal sheet stock. The axle 65 can extend through appropriate slots or bores within each of the diverter ribs 62. The metal components can then be bonded or welded in a known manner.

Most preferably, the feed and presenter surfaces of either the diverter ribs 60 or the diverter body 42 provide a smooth, generally frictionless surface for movement of paper P across the surface. In addition, it is preferable that the diverter mechanism be "static free". For instance, the pertinent surfaces or edges can be coated with a Mylar material.

In each of the two illustrated embodiments, the diverter mechanism 40, 60 is pivotably mounted within the printer apparatus 10. A pivoting mount is preferred because the diverter body can be balanced so that only a minimal amount of force need be exerted by the sheet of paper P to pivot the body upward in the direction of the arrow U in FIG. 3*b*. In addition, the relative position of the center of gravity to the pivot axis can be calibrated to minimize the required pivoting force. A guide plate or roller can be provided adjacent the diverter mechanism and facing a feed surface to help hold the sheet against the feed surface and reduce the possibility of a paper jam at that location.

While the most preferred embodiments of the present invention contemplate pivotably mounting the diverter mechanism 40, 60, other mounting arrangements can be contemplated. In accordance with one principle of the invention, it is important that whatever mounting arrangement is utilized the diverter mechanism be permitted substantially unconstrained or un-powered movement between its plural operative positions. Most preferably, this movement is in response to contact by the sheet of paper P as it travels in its feed direction F. In addition, the mounting arrangement must allow the diverter mechanism 40, 60 to fall by the force of gravity to its second operative position (FIG. 3*c*) to guide the paper in the discharge direction D. Thus, the diverter mechanisms 40, 60 can be mounted for vertical movement as the sheet passes through the mechanism. This substantially unconstrained movement can be accomplished by situating the axle, such as axle 65, within a vertical slot, rather than within a circular opening or bushing.

In the illustrated embodiments, the diverter mechanisms 40, 60 are shown disposed in a generally horizontal arrangement. However, the spatial orientation of the diverter mechanism can be based on the relative positioning between the paper feed mechanism 14 and the presenter mechanism 16. In addition, the configuration and orientation of the feed and presenter surfaces relative to each other can be determined by the layout of the printer apparatus 10.

While this invention has been described as having an exemplary structure, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the claims.

What is claimed is:

1. A printer apparatus comprising:

a printer mechanism for printing on a sheet;

a feed mechanism for feeding the sheet from a supply location through said printer mechanism to a collection location;

a discharge mechanism for discharging the sheet from the collection location to a discharge location; and a diverter disposed between said printer mechanism and the collection location and defining a first surface configured to direct the sheet to the collection location and a second surface configured to direct the sheet to the discharge location, said diverter movable by contact of the sheet with said first surface from a neutral position in which said second surface is aligned to receive the sheet from said discharge mechanism and a displaced position relative to said neutral position.

2. The printer apparatus according to claim 1, wherein said diverter is pivotably mounted within said apparatus.

3. The printer apparatus according to claim 2, wherein said diverter includes said first and second surfaces extending from a common edge, a base portion between said first and second surfaces opposite said common edge, and a pivot axis adjacent said base for pivotably mounting said diverter.

4. The printer apparatus according to claim 3, wherein said diverter has a center of gravity offset from said pivot axis toward said common edge.

5. The printer apparatus according to claim 2, wherein said diverter includes a plurality of ribs supported on an axle pivotably mounted within said apparatus.

6. The printer apparatus according to claim 1, wherein said diverter is mounted above said feed mechanism so that said diverter is movable against the force of gravity by contact of the sheet with said first surface.

7. The printer apparatus according to claim 6, wherein said diverter is pivotably mounted within said apparatus.

8. The printer apparatus according to claim 7, wherein said diverter includes said first and second surfaces extending from a common edge, a base portion between said first and second surfaces opposite said common edge, and a pivot axis adjacent said base for pivotably mounting said diverter.

9. The printer apparatus according to claim 8, wherein said diverter has a center of gravity offset from said pivot axis toward said common edge.

10. A printer apparatus comprising:

a printer mechanism for printing on a sheet;

a feed mechanism for feeding the sheet from a supply location through said printer mechanism to a collection location;

a discharge mechanism for discharging the sheet from the collection location to a discharge location; and a diverter disposed between said printer mechanism and the collection location and having a first position arranged to direct the sheet to the collection location and a second position arranged to direct the sheet to the discharge location, said diverter movable by contact of the sheet between said first and second positions.

11. The printer apparatus according to claim 10, wherein said diverter is mounted within said apparatus for unconstrained movement between said first and second positions.

12. The printer apparatus according to claim 11, wherein said diverter is mounted within said apparatus so that said diverter is movable by contact of the sheet from one position of said first or second positions to the other position of said first or second positions, and is movable by gravity from said other position to said one position when said diverter is not in contact with the sheet.

13. The printer apparatus according to claim 10, wherein said diverter is pivotably mounted within said apparatus about a pivot axis.

14. The printer apparatus according to claim 13, wherein said diverter defines a center of gravity offset from said pivot axis.

15. The printer apparatus according to claim 14, wherein said center of gravity is arranged relative to said pivot axis to gravity bias said diverter to said second position.

16. The printer apparatus according to claim 10, wherein said diverter defines a first surface configured to direct the sheet to the collection location when said diverter is in said first position and a different second surface configured to direct the sheet to the discharge location when said diverter is in said second position.

17. In a printer apparatus having a printer mechanism for printing on a sheet, a feed mechanism for feeding the sheet from a supply location through the printer mechanism to a collection location, and a discharge mechanism for discharging the sheet from the collection location to a discharge location, a method for directing the sheet from the supply location to the discharge location comprising the steps of:

providing a diverter disposed between the printer mechanism and the collection location, the diverter having a first position arranged to direct the sheet to the collection location and a second position arranged to direct the sheet to the discharge location;

feeding the sheet in a first direction of travel from the supply location to the diverter;

moving the diverter to the first position by contact of the sheet with the diverter;

feeding the sheet past the diverter in the first direction of travel into the collection location;

moving the diverter to the second position by gravity when the sheet is past the diverter;

reversing the direction of travel of the sheet and feeding the sheet in a second direction of travel to the diverter in its second position; and feeding the sheet past the diverter to the discharge location.

18. In a printer apparatus having a printer mechanism for printing on a sheet, a feed mechanism for feeding the sheet in a first direction of travel from a supply location through said printer mechanism to a collection location, and a discharge mechanism for discharging the sheet in a second direction of travel from the collection location to a discharge location, the improvement comprising:

a diverter disposed between the printer mechanism and the collection location and mounted within the apparatus for substantially unconstrained movement between a first position arranged to direct the sheet to the collection location when the sheet is traveling in the first direction, and a second position arranged to direct the sheet to the discharge location when the sheet is traveling in the second direction.

19. The improvement according to claim 18, wherein said diverter is mounted within the apparatus so that said diverter is gravity biased to said second position and is movable to said first position by contact with the sheet traveling in the first direction.

20. The improvement according to claim 19, wherein said diverter is pivotably mounted within the apparatus.

* * * * *